US005845870A

United States Patent [19]

Angle

[11] Patent Number: 5,845,870

[45] Date of Patent: Dec. 8, 1998

[54] TOILET PAPER HOLDING DEVICE

[76] Inventor: Steve R. Angle, 5824 S. Jordan Canal Rd., Sandy, Utah 84118

[21] Appl. No.: 958,293

[22] Filed: Oct. 27, 1997

[51] Int. Cl.[6] ..... B65H 16/06

[52] U.S. Cl. ..... 242/598.5; 242/598.3

[58] Field of Search ..... 242/598, 598.3, 242/598.5, 598.6

[56] References Cited

U.S. PATENT DOCUMENTS

| | | | |
|---|---|---|---|
| D. 257,082 | 9/1980 | Williams . | |
| D. 292,155 | 10/1987 | Meils . | |
| D. 305,488 | 1/1990 | Korpijaako . | |
| D. 377,284 | 1/1997 | Farrow et al. . | |
| 1,643,380 | 9/1927 | Jordan | 242/598.3 |
| 2,374,586 | 4/1945 | Dessaur | 242/598.3 |
| 3,037,718 | 6/1962 | Petit | 242/598.3 |
| 3,171,135 | 3/1965 | Polichio . | |
| 3,291,354 | 12/1966 | Ziebarth . | |
| 3,304,034 | 2/1967 | Jones | 242/598.3 |
| 3,467,330 | 9/1969 | Yavitch | 242/598.3 |
| 3,799,467 | 3/1974 | Bauman . | |
| 3,943,859 | 3/1976 | Boone . | |
| 4,106,617 | 8/1978 | Boone . | |
| 5,170,958 | 12/1992 | Brown . | |
| 5,248,105 | 9/1993 | Cooker . | |
| 5,570,938 | 11/1996 | Butler . | |

*Primary Examiner*—John P. Darling
*Attorney, Agent, or Firm*—Thorpe, North & Western, LLP

[57] ABSTRACT

A wall mounted toilet paper dispenser, comprising a back wall member having two side edges and a width slightly wider than a roll of toilet paper. Opposing side walls are coupled to the two side edges of the back wall member, each side wall having a front edge and an interior face forming opposing sides of a compartment for housing the roll of toilet paper. The side walls include opposing receptacles configured for receiving opposing ends of a telescopically sliding, spring biased toilet paper support tube. A mounting flange is coupled to the front edges of the opposing side walls and extends around an opening of the compartment as a perimeter fascia. At least one of the interior faces of the side walls includes a recessed guide channel having an open channel end exposed near the opening of the compartment for receiving an end of the support tube when the support tube is fully extended. The channel has a glide face and opposing channel side walls which are inclined inward with a tapering width between the compartment side walls to depress and shorten the support tube as it slides rearward within the channel to be locked in place in an extended configuration in the opposing receptacles.

17 Claims, 2 Drawing Sheets

TOILET PAPER HOLDING DEVICE

BACKGROUND OF THE INVENTION

1. Field of the Invention

The present invention relates to fixtures for use within a bathroom for holding toilet paper. Specifically, the invention pertains to wall mounted fixtures which are flush with the wall surface with automatic positioning of the roll of toilet paper within a storage compartment.

2. Prior Art

The selection of bathroom fixtures is often determined by both convenience and decor. Convenience with respect to toilet paper dispensers primarily involves positioning the dispenser in proximate location to the user with the toilet paper being easily accessible. Typically, the toilet paper is suspended on a tubular holder removably journalled in receptacles at the end of support arms. These support arms generally project outward from the casement of the fixture and the bathroom wall and therefore position the toilet paper roll out within the free space away from the bathroom wall.

The tubular holder is commonly made up of two tubes of slightly different diameters which are telescopically slidable, one within the other. The tubes are spring biased to a length which is longer than the distance between opposing ends of the support arms. This enables the holder to be compressed to a shorter length so that it can be moved in between the receiving slot in the support arms until the opposing ends of the tubular holder are aligned with the ends of the support arms. The holder is then released, permitting the spring biasing to extend the holder to a seated position within the receptacles.

Prior art positioning has generally required the user to use both hands to compress the holder while inserting a role of supported toilet paper into position. Otherwise, the user must carefully align and insert one end of the holder into one of the receptacles, then compress the holder to the contracted configuration for positioning the opposing end in the remaining receptacle. This is illustrated in U.S. Pat. No. 3,171,135 by Polichio wherein the roll 16 is suspended in the casement. This patent also illustrates the use of a back wall 13 and side walls 16 for defining an enclosed compartment for the roll of toilet paper. These features are also illustrated in U.S. Pat. No. 3,291,354 by Ziebarth. Both of these references show the mounting of the casement partially forward of the wall, with the toilet paper extending out in the room space.

Many variations of dispensers have been developed over the years. In addition to the conventional devices referenced above, U.S. Pat. No. 5,170,958 by Brown depicts a fully enclosed dispenser. This also illustrates the variety of locations that the paper can be withdrawn, as well method of attachment 29 to the wall.

An additional variation includes the use of a shelf to support associated items. Des. U.S. Pat. No. 305,488 by Korpijaako; U.S. Pat. No. 3,799,467 by Bauman; U.S. Pat. No. 3,943,859 by Boone; U.S. Pat. No. 4,106,617 by Boone; Des U.S. Pat. No. 377,284 by Farrow and U.S. Pat. No. 5,248,105 by Cooker all demonstrate how different shelves and enclosures can be attached to the casement. Such shelves and enclosures are useful for containing a variety of useful items.

A further modification of such fixtures includes the use of a flush mounted fascia which enables the roll of toilet paper to be recessed within the wall. This is illustrated in Des U.S. Pat. No. 292,155 by Miels. This patent also discloses the use of a door or cover over the dispenser compartment. Des U.S. Pat. No. 257,082 depicts a cabinet form of dispenser with multiple storage compartments for extra rolls. Note that this design is also configured for flush mounting at the wall. U.S. Pat. No. 5,570,938 by Butler shows a cabinet which is used solely for storage, without the associated dispenser mechanism.

It is clear that all these dispenser devices share certain common characteristics. For example, the roll of paper is positioned on the support arms or casement by manually manipulating the telescopic, tubular support or other support device into receptacles which suspend the toilet paper within the compartment. Typically, this will require two hands to guide and compress the support to a seated position. Removing the support member with a spent roll is likewise awkward, particularly with support members that are set back into the casement recessed within the wall.

What is needed is a toilet paper dispenser which can be replenished with a single hand and convenient movement of the telescopic support member into the recessed, stored position.

OBJECTS AND SUMMARY OF THE INVENTION

It is an object of the present invention to provide a bathroom fixture for supporting toilet paper rolls which is fully recessed within the wall and includes guide structure for sliding the tubular support member into a seated position with a single hand.

It is a further object of this invention to provide such a fixture having side walls that guide the support member automatically into the correct position for emplacement.

Yet another object of this invention is to provide a bathroom fixture which includes a storage compartment for deodorant and the like.

A still further object of this invention is to facilitate automatic release of the deodorant spray by a level accessible outside the casement of the fixture.

These and other objects are realized in a wall mounted toilet paper dispenser, comprising a back wall member having two side edges and a width slightly wider than a roll of toilet paper. Opposing side walls coupled to the two side edges of the back wall member each have a front edge and an interior face forming opposing sides of a compartment for housing the roll of toilet paper. Each of the side walls has opposing receptacles configured for receiving opposing ends of a telescopically sliding, spring biased toilet paper support tube. A mounting flange is coupled to the front edges of the opposing side walls and extend around an opening of the compartment as a perimeter fascia. At least one of the interior faces of the side walls includes a recessed guide channel having an open channel end exposed near the opening of the compartment for receiving an end of the support tube when the support tube is fully extended. This channel includes a glide face and opposing channel side walls, wherein the glide face is inclined inward with a tapering width between the compartment side walls to depress and shorten the support tube as it slides rearward within the channel to be locked in place in an extended configuration in the opposing receptacles. A deodorant dispenser is also disclosed with an automatic mechanism for releasing deodorant by depressing a lever on the outside of the casement.

Other objects and features of the present invention will be apparent to those skilled in the art, based on the following detailed description of preferred embodiments, taken with the accompanying drawings.

DESCRIPTION OF PREFERRED EMBODIMENTS

Figure 1:
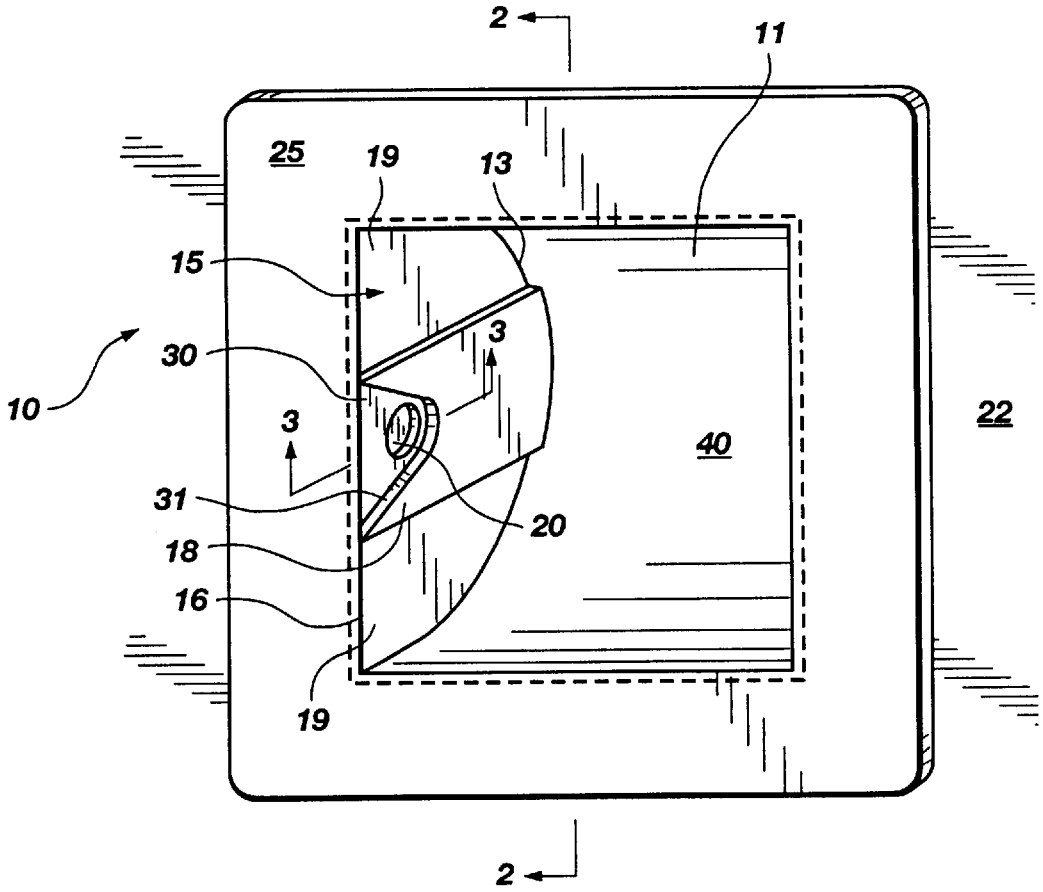
FIG. 1 depicts a perspective view of a bathroom fixture attached to a wall in accordance with the present invention.
Figure 2:
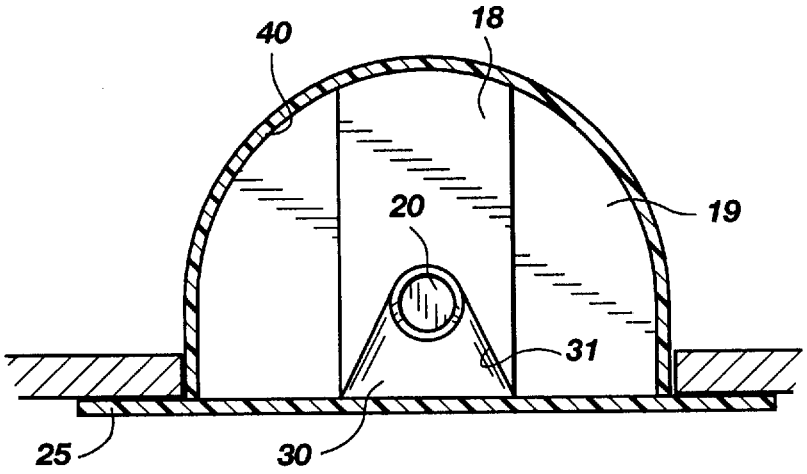
FIG. 2 shows a cross sectional view of the fixture of FIG. 1, taken along the lines 2—2.
Figure 3:
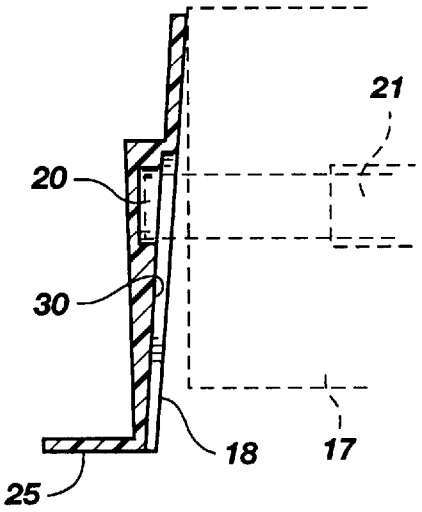
FIG. 3 illustrates a cross-sectional view of a side wall with guide channel, taken along the lines 3—3.

A wall mounted toilet paper dispenser embodying the principles of the present invention is shown at 10. The dispenser includes a back wall member 11 having two side edges 13 and a width slightly wider than a roll of toilet paper 17. Although the preferred configuration of the back wall is arcuate, it may also be rectangular or of other polygon structure. It may also be perforated or of screen or grid construction. Composition is preferably of plastic and may be easily formed by injection molding techniques with conventional polymers.

The opposing side walls 15 of the dispenser are coupled to the two side edges 13 of the back wall member. This may be easily included within the mold structure so that the combination is injection molded as a single piece. Each side wall includes a front edge 16 and an interior face 19 and ramp face 18 forming opposing sides of a compartment for housing the roll of toilet paper. These side walls are formed with opposing receptacles 20 which are configured for receiving opposing ends of a telescopically sliding, spring biased toilet paper support tube 21. Such tubes are commonly used by inserting through the toilet paper roll axis, and sliding the tube into the receptacles which suspend the roll in the dispenser. When the toilet paper is completely used, the roll and tube is retracted from the receptacles.

The dispenser is typically mounted at the wall 22 adjacent the toilet. The preferred embodiment of the present invention enables a flush mount at the wall surface. This avoids having the toilet paper extend into the room, but rather allows the roll to be recessed within the space between wall studs. This is accomplished with mounting flanges 25 coupled to the front edges of the opposing side walls and extending around an opening of the compartment as a perimeter fascia. The back side of the flange includes a strip of two-sided adhesive, enabling the dispenser to be adhered directly on the wall face at an opening in the wall for the dimensions of the dispenser. With an opening just larger than the sidewall perimeter, any gap around the dispenser at the wall is concealed by the mounting flange.

An important feature of the present embodiment includes a recessed guide channel 30 positioned at least one of the interior faces of the side walls. The guide channel is formed as an open channel end exposed near the opening of the compartment for receiving an end of the support tube when the support tube is fully extended. The channel includes a glide face and opposing channel side walls 31. The glide face is preferably inclined inward with a tapering width between the compartment side walls to depress and shorten the support tube as it slides rearward within the channel to be locked in place in an extended configuration in the opposing receptacles.

Typically, the recessed guide channel joins and opens to the opposing receptacles to enable the ends of the support tube to slide along the channel and directly into the receptacles. Each side wall of the compartment includes the recessed guide channel in common orientation such that the opposing ends of the support tube can slide in tandem from the opening of the compartment to the opposing receptacles. The recessed guide channels diverge from a width common with a diameter of the receptacles to a wider diameter at the opening of the compartment. This wider opening allows a mere proximity position of the support tube, with the converging side walls being operable to guide the support tube into the narrow part of the channel until the tube naturally falls into the receptacles in a secure configuration. A preferred diameter at the opening is at least twice the diameter at the receptacles. The guide face side wall is preferably inclined inward from the opening of the compartment to a narrow width which is approximately one fourth inch to one inch shorter in width.

Finally, the guide face has an angle of inclination within the range of 2 to 10 degrees with respect to the plane of the side wall. The ideal range of inclination is between 2–4 degrees.

The preferred embodiment of this invention is more specifically configured with the back wall 40 having a continuous plate extending from a top, front edge of the opening of the compartment, along the back of the compartment to the bottom front edge of the opening of the compartment. Ideally, the back wall is configured in an arcuate shape which conforms to the curvature of the roll of toilet paper. In this configuration, the back wall and attached side walls form a full enclosure for the compartment except for the opening of the compartment.

Figure 4:
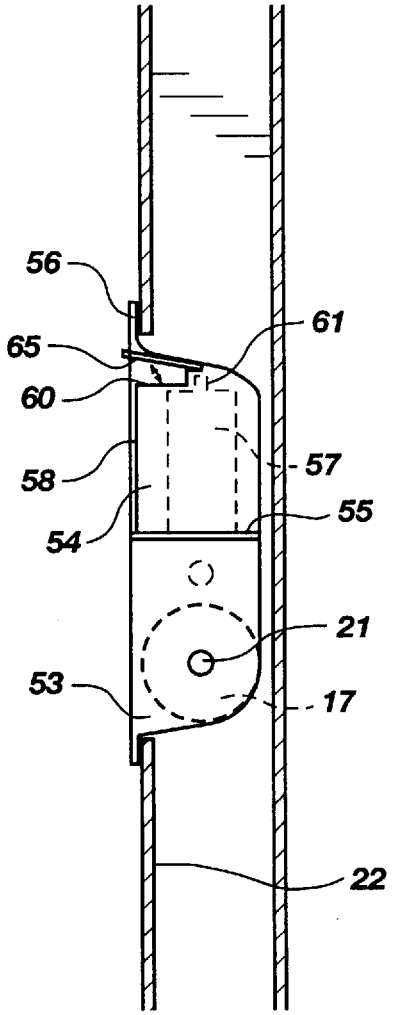
FIG. 4 depicts the bathroom fixture including a compartment for deodorant and automatic discharge of the deodorant contents.

The above described dispenser 53 (FIG. 4) may be modified with a second compartment, 54 integrally coupled at a top edge 56 of the back wall member which includes a second mounting flange coupled around a front opening of the second compartment to form a perimeter fascia. This compartment is configured with a shelf 55 to support a pressurized deoderant container 57 for storage. A movable door 58 may be coupled at the front opening of the second compartment to cover the compartment when in a closed position.

The deodorant compartment would ideally include a depressable activating member 60 extending into the second compartment which is positioned to engage a release valve 61 of the deodorant container. The activating member may be configured as a lever with a first end positioned within the second compartment to engage the release valve of the deodorant container. The lever has a second end extending to the perimeter fascia of the second compartment in a position accessible for manual depression by a user. Deodorant is dispensed through a conduit 65 coupled to the second compartment and positioned for coupling to an end of the deodorant container. This conduit communicates to an exterior location with respect to the second compartment to enable release of deodorant outside the second compartment.

It will be apparent to those skilled in the art, that the disclosed embodiments are representative of the invention, and is not to be construed as limiting, except as set forth in the following claims.

I claim:

1. A wall mounted toilet paper dispenser, comprising:

a back wall member having two side edges and a width wider than a roll of toilet paper;

opposing side walls coupled to the two side edges of the back wall member, each side wall having a front edge and an interior face forming opposing sides of a compartment for housing the roll of toilet paper, said side walls having opposing receptacles configured for receiving opposing ends of a telescopically sliding, spring biased toilet paper support tube;

a mounting flange coupled to the front edges of the opposing side walls and extending around an opening of the compartment as a perimeter fascia;

at least one of said interior faces of the side walls including a recessed guide channel having an open channel end exposed near the opening of the compartment for receiving an end of the support tube when the support tube is fully extended, said channel having a glide face and opposing channel side walls, said glide face being inclined inward with a tapering width between the compartment side walls to depress and shorten the support tube as it slides rearward within the channel to be locked in place in an extended configuration in the opposing receptacles.

2. A dispenser as defined in claim 1, wherein the back wall member comprises a continuous plate extending from a top, front edge of the opening of the compartment, along the back of the compartment to the bottom front edge of the opening of the compartment.

3. A dispenser as defined in claim 2, wherein the back wall member is configured in an arcuate shape which conforms to the curvature of the roll of toilet paper.

4. A dispenser as defined in claim 3, wherein the back wall member and attached side walls forms a full enclosure for the compartment except for the opening of the compartment, said mounting flange forming a full perimeter around the opening.

5. A dispenser as defined in claim 1, wherein the opposing receptacles within the sides walls of the compartment have a configuration larger and conforming to the opposing ends of the support tube to enable the support tube to fit within the opposing receptacles.

6. A dispenser as defined in claim 1, wherein mounting flange includes two-sided tape for adhering the dispenser to a surrounding face of a wall and within an opening cut through the wall in a perimeter shape corresponding to the perimeter shape of the dispenser.

7. A dispenser as defined in claim 1, wherein the recessed guide channel joins and opens to the opposing receptacles to enable the ends of the support tube to slide along the channel and directly into the receptacles.

8. A dispenser as defined in claim 7, wherein each side wall of the compartment includes the recessed guide channel in common orientation such that the opposing ends of the support tube can slide in tandem from the opening of the compartment to the opposing receptacles.

9. A dispenser as defined in claim 8, wherein the recessed guide channels diverge from a width common with a diameter of the receptacles to a wider diameter at the opening of the compartment.

10. A dispenser as defined in claim 9, wherein the wider diameter at the opening is at least twice the diameter at the receptacles.

11. A dispenser as defined in claim 1, wherein the glide face side wall is inclined inward from the opening of the compartment to a narrow width which is approximately one fourth inch to one inch shorter in width.

12. A dispenser as defined in claim 11, wherein the glide face has an angle of inclination within the range of 2 to 10 degrees with respect to the plane of the side wall.

13. A dispenser as defined in claim 1, further comprising a second compartment integrally coupled at a top edge of the back wall member and including a second mounting flange coupled around a front opening of the second compartment to form a perimeter fascia, said second compartment extending rearward from the perimeter fascia, said compartment being configured to receive a deodorant container for storage therein.

14. A dispenser as defined in claim 13, further including a movable door coupled at the front opening of the second compartment to cover the compartment when in a closed position.

15. A dispenser as defined in claim 13, wherein the second compartment further includes an activating member extending into the second compartment and being positioned to engage a release valve of the deodorant container.

16. A dispenser as defined in claim 15, wherein the activating member comprises a lever having a a first end positioned within the second compartment to engage the release valve of the deodorant container, said lever having a second end extending to the perimeter fascia of the second compartment in a position accessible for manual depression by a user.

17. A dispenser as defined in claim 13, further comprising a conduit coupled to the second compartment and positioned for coupling to an end of the deodorant container, said conduit communicating to an exterior location with respect to the second compartment to enable release of deodorant outside the second compartment.

* * * * *